US011879459B2

(12) United States Patent
Katayama et al.

(10) Patent No.: US 11,879,459 B2
(45) Date of Patent: Jan. 23, 2024

(54) ROTARY COMPRESSOR INCLUDING A PLURALITY OF RECESSED PORTIONS FOR RETAINING LUBRICATING OIL

(71) Applicant: FUJITSU GENERAL LIMITED, Kanagawa (JP)

(72) Inventors: Hiroki Katayama, Kanagawa (JP); Motonobu Furukawa, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/793,293

(22) PCT Filed: Sep. 30, 2020

(86) PCT No.: PCT/JP2020/037306
§ 371 (c)(1),
(2) Date: Jul. 15, 2022

(87) PCT Pub. No.: WO2021/152915
PCT Pub. Date: Aug. 5, 2021

(65) Prior Publication Data

US 2023/0050050 A1 Feb. 16, 2023

(30) Foreign Application Priority Data

Jan. 29, 2020 (JP) ..... 2020-012921

(51) Int. Cl.
*F04C 18/356* (2006.01)
*F04C 2/344* (2006.01)
(Continued)

(52) U.S. Cl.
CPC ..... *F04C 18/3564* (2013.01); *F04C 2/3448* (2013.01); *F04C 29/02* (2013.01);
(Continued)

(58) Field of Classification Search
CPC ..... F04C 2/344–3568; F04C 18/344–3568; F04C 15/0088; F04C 15/0092;
(Continued)

(56) References Cited

U.S. PATENT DOCUMENTS 5,516,212 A 5/1996 Titcomb
2005/0172646 A1* 8/2005 Kawabata ..... F04C 29/02 62/468
(Continued)

FOREIGN PATENT DOCUMENTS

JP H05-007986 U 2/1993
JP H05-044671 A 2/1993
(Continued)

OTHER PUBLICATIONS

Jun. 8, 2021, Japanese Office Action issued for related JP Application No. 2020-012921.

*Primary Examiner* — Laert Dounis
(74) *Attorney, Agent, or Firm* — Paratus Law Group, PLLC

(57) ABSTRACT

A compression unit of a rotary compressor includes a cylinder, an upper end plate that closes the upper side of the cylinder, a lower end plate that closes the lower side of the cylinder, and a piston that is fitted to a rotating shaft, revolves along an inner peripheral surface of the cylinder, and forms a cylinder chamber in the cylinder. At least one of an end face of the piston in the axial direction of the rotating shaft, a sliding surface of the upper end plate that slides with the end face of the piston, and a sliding surface of the lower end plate that slides with the end face of the piston, has formed therein an oil-film retention region having an array of a plurality of recessed portions that retain lubricating oil.

4 Claims, 8 Drawing Sheets

(51) Int. Cl.
*F04C 29/02* (2006.01)
*F04C 23/00* (2006.01)

(52) U.S. Cl.
CPC ..... *F04C 29/028* (2013.01); *F04C 23/008* (2013.01); *F04C 2230/92* (2013.01); *F04C 2240/20* (2013.01); *F04C 2240/30* (2013.01)

(58) Field of Classification Search
CPC .... F04C 29/02–028; F01C 1/344–3568; F01C 21/04; F01C 21/045
See application file for complete search history.

(56) References Cited

U.S. PATENT DOCUMENTS

| | | | | |
|---|---|---|---|---|
| 2009/0161998 | A1* | 6/2009 | Jiang | F16C 33/10 384/100 |
| 2016/0108916 | A1* | 4/2016 | Horibe | F01C 21/10 418/79 |

FOREIGN PATENT DOCUMENTS

| | | | | | |
|---|---|---|---|---|---|
| JP | H08-319975 | A | | 12/1996 | |
| JP | H09209952 | A | * | 8/1997 | |
| JP | 2004-316533 | A | | 11/2004 | |
| JP | 2004316533 | A | * | 11/2004 | |
| JP | 2007-225013 | A | | 9/2007 | |
| JP | 2011-122556 | A | | 6/2011 | |
| JP | 2012-041894 | A | | 3/2012 | |
| WO | WO-2016098710 | A1 | * | 6/2016 | F01C 21/108 |

* cited by examiner

ROTARY COMPRESSOR INCLUDING A PLURALITY OF RECESSED PORTIONS FOR RETAINING LUBRICATING OIL

CROSS REFERENCE TO PRIOR APPLICATION

This application is a National Stage Patent Application of PCT International Patent Application No. PCT/JP2020/037306 (filed on Sep. 30, 2020) under 35 U.S.C. § 371, which claims priority to Japanese Patent Application No. 2020-012921 (filed on Jan. 29, 2020), which are all hereby incorporated by reference in their entirety.

FIELD

The present invention relates to a rotary compressor.

BACKGROUND

In air conditioners and refrigeration units, rotary compressors are used to compress a refrigerant. In the rotary compressor, a compression unit that compresses the refrigerant includes an annular cylinder, an upper end plate that closes the upper side of the cylinder, a lower end plate that closes the lower side of the cylinder, a piston that revolves along the inner peripheral surface of the cylinder and forms a cylinder chamber in the cylinder, and a vane that projects into the cylinder chamber from a vane groove provided in the cylinder and is brought into contact with a peripheral surface of the piston to section the cylinder chamber into a suction chamber and a compression chamber. The compression chamber, which compresses the refrigerant, is sealed by an oil film of lubricating oil, which adheres to the vane and the piston, so as to prevent the high-pressure refrigerant gas the compression chamber from leaking to the suction chamber side, thereby ensuring the airtightness in the compression chamber.

CITATION LIST

Patent Literature

Patent Literature 1: Japanese Patent Application Laid-open. No. 2007-225013

SUMMARY

Technical Problem

In the above-described compression unit, by enhancing the airtightness of the compression chamber by the oil film of lubricating oil, the compression efficiency of the refrigerant Gas in the compression chamber is increased. In particular, when a gap between an upper end face of the piston and a sliding surface of the upper end plate in the axial direction of the rotating shaft, and a gap between a lower end face of the piston and a sliding surface of the lower end plate, are reduced due to downsizing of the compression unit, forming of an oil film in a small gap may be difficult, so that the sealing property of the compression chamber by the oil film may deteriorate and the compression efficiency of the compression chamber may be lowered.

The disclosed technology has been made in view of the foregoing, and an object thereof is to provide a rotary compressor capable of enhancing the sealing property, of the compression chamber by the oil film, and increasing the compression efficiency of the compression chamber.

Solution to Problem

According to an aspect of an embodiments in the present application, a rotary compressor includes: a compressor housing that is provided with a refrigerant discharge portion and a refrigerant suction portion; a compression unit that is arranged in the compressor housing and configured to compress a refrigerant, which is sucked from the suction portion, and discharge the refrigerant from the discharge portion; and a motor that is arranged in the compressor housing and configured to drive the compression unit, wherein the compression unit includes an annular cylinder; an upper end plate that closes an upper side of the cylinder; a lower end plate that closes a lower side of the cylinder; a rotating shaft that is rotated by the motor; a piston that is fitted to the rotating shaft and is configured to revolve along an inner peripheral surface of the cylinder and form a cylinder chamber in the cylinder; a vane that projects from a vane groove provided on the cylinder into the cylinder chamber and brought into contact with the piston so as to section the cylinder chamber into a suction chamber and a compression chamber, and at least one of an end face of the piston in an axial direction of the rotating shaft, a sliding surface of the upper end plate that slides with the end face of the piston, and a sliding surface of the lower end plate that slides with the end face of the piston, has formed therein an oil-film retention region having an array of a plurality of recessed portions that are configured to retain lubricating oil.

Advantageous Effects of Invention

According to one aspect of the rotary compressor disclosed in the present application, the sealing property of the compression chamber by the oil film can be enhanced, and the compression efficiency of the compression chamber can be increased.

DESCRIPTION OF EMBODIMENTS

The following describes detail an exemplary embodiment of a rotary compressor disclosed in the present application with reference to the accompanying drawings. The rotary compressor, disclosed in the present application, is not limited by the following exemplary, embodiment.

EMBODIMENT

Configuration of Rotary Compressor

Figure 1:
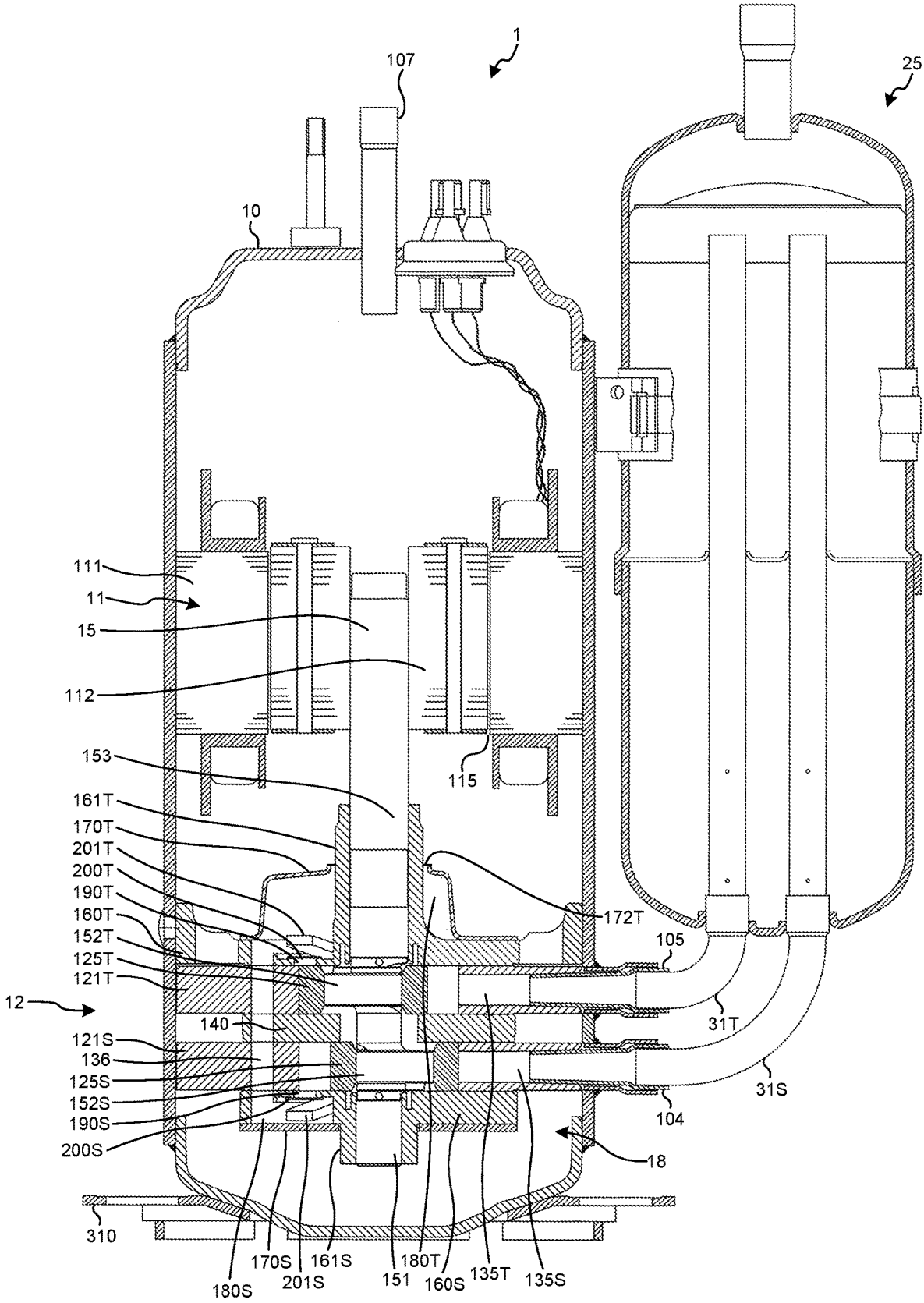
FIG. 1 is a longitudinal sectional view illustrating a rotary compressor of an embodiment.
Figure 2:
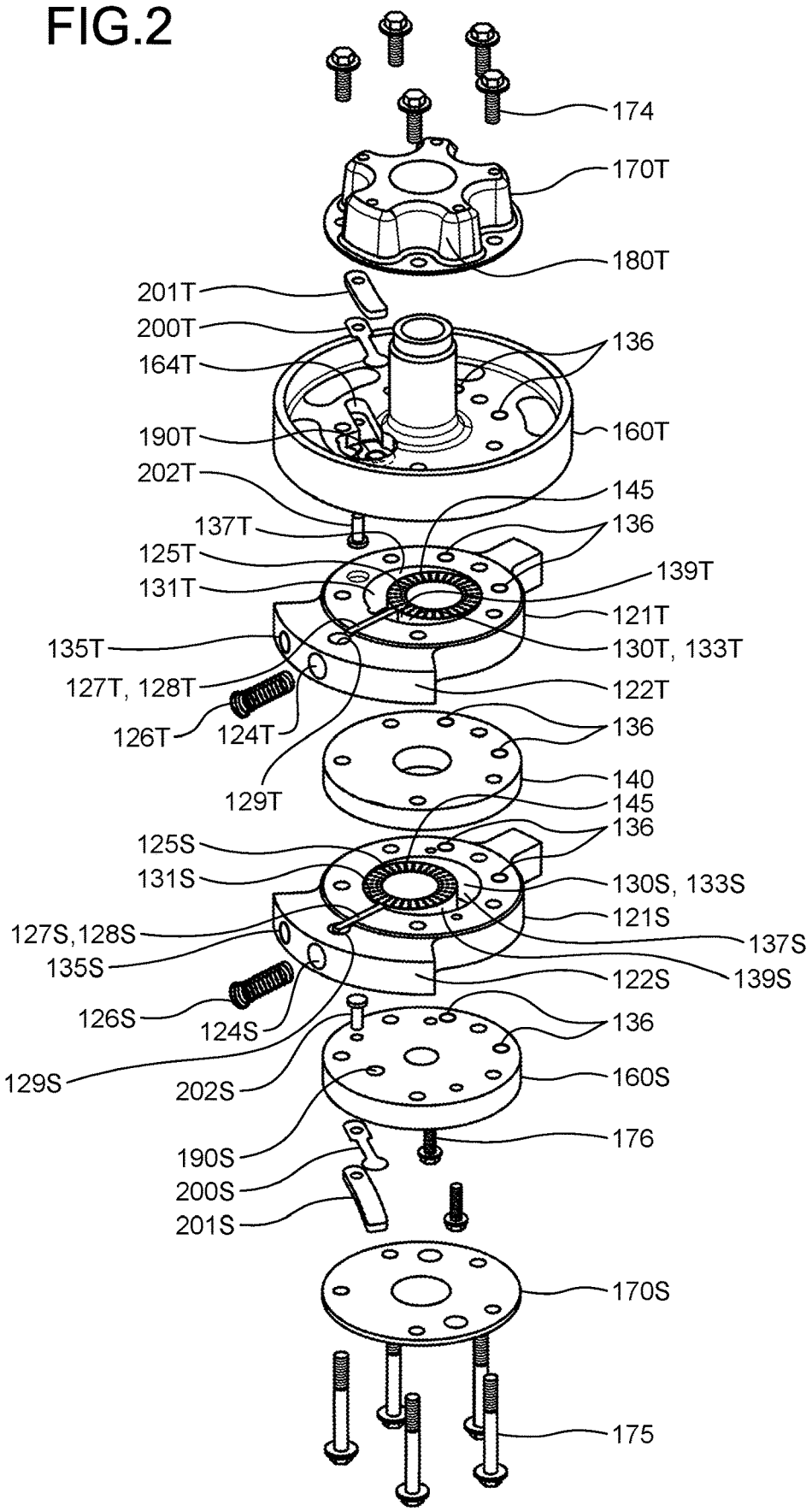
FIG. 2 is an exploded perspective view illustrating a compression unit of the rotary compressor of the embodiment.

FIG. 1 is a longitudinal sectional view illustrating a rotary compressor of an embodiment. FIG. 2 is an exploded perspective view illustrating a compression unit of the rotary compressor of the embodiment.

As illustrated in FIG. 1, a rotary compressor 1 includes a compression unit 12, which is arranged at a lower portion in a sealed and vertical cylindrical compressor housing 10, a motor 11, which is arranged at an upper portion in the compressor housing 10 and configured to drive the compression unit 12 via a rotating shaft 15, and a vertical cylindrical accumulator 25, which is fixed to an outer peripheral surface of the compressor housing 10.

The accumulator 25 includes a vertically placed cylindrical accumulator container 26, and a low-pressure introduction pipe 27, which is connected to the upper portion of the accumulator container 26. The accumulator container 26 is connected to an upper cylinder chamber 130T (see FIG. 2) of an upper cylinder 121T via an upper suction pipe 105 and an L-shaped low-pressure connecting pipe 31T, and is connected to a lower cylinder chamber 130S (see FIG. 2) of a lower cylinder 121S via a lower suction pipe 104 and an L-shaped low-pressure connecting pipe 31S. The low-pressure introduction pipe 27 is provided through the upper portion of the accumulator container 26, and is connected to the low-pressure side of the refrigerant pipe in the refrigeration cycle. In the accumulator container 26, between the low-pressure introduction pipe 27 and the low-pressure connecting pipes 31T and 31S, a filter 29 that captures foreign matter from the refrigerant, which is supplied from the low-pressure introduction pipe 27, is provided.

The motor 11 includes a stator 111, which is arranged on the outside, and a rotor 112, which is arranged on the inside. The stator 111 is fixed to the inner peripheral surface of the compressor housing 10 in a shrink fitted state, and the rotor 112 is fixed to the rotating shaft 15 in a shrink fitted state.

A sub shaft portion 151 below a lower eccentric portion 152S is rotatably supported by a sub bearing portion 161S, which is provided on a lower end plate 160S, a main shaft portion 153 above an upper eccentric portion. 152T is rotatably supported by a main bearing portion 161T, which is provided on an upper end plate 160T, and an upper piston 125T and a lower piston 125S are supported by the upper eccentric portion 152T and the lower eccentric portion 152 respectively that are provided with a phase difference of 180 degrees to each other, whereby the rotating shaft 15 is rotatably supported with respect to the compression unit 12, and causes the upper piston 125T and the lower piston 125S to revolve along an inner peripheral surface 137T of the upper cylinder 121T and an inner peripheral surface 137S of the lower cylinder 121S respectively by the rotation.

On the inside of the compressor housing 10, lubricating oil (refrigerating machine oil) 18 is sealed by an amount that substantially immerses the compression unit 12, in order to ensure lubricity of sliding portions such as the upper piston 125T and the lower piston 125S, which slide in the compression unit 12, and to seal an upper compression chamber 133T (see FIG. 2) and a lower compression chamber 133S (see FIG. 2). On the lower side of the compressor housing 10, fixed are mounting legs 310 (see FIG. 1) for hooking a plurality of elastic supporting members (not depicted), which support the entire rotary compressor 1.

As illustrated in FIG. 1, the compressor housing 10 is provided with a discharge pipe 107 at the upper portion as a discharge portion for discharging a refrigerant, and an upper suction nice 105 and a lower suction pipe 104 on the side portion as suction portions for sucking the refrigerant. The compression unit 12 compresses the refrigerant, which is sucked in from the upper suction pipe 105 and the lower suction pipe 104, and discharges it from the discharge pipe 107. As illustrated in FIG. 2, the compression unit 12 is made up of, from above, stacking an upper end plate cover 170T that has a bulging portion in which a hollow space is formed inside, the upper end plate 160T, the annular upper cylinder 121T, an intermediate partition plate 140, the annular lower cylinder 121S, the lower end plate 160S, and a flat plate-shaped lower end plate cover 170S. The entire compression unit 12 is fixed from above and below by a plurality of through bolts 174 and 175 and auxiliary bolts 176 arranged substantially concentrically.

As illustrated in FIG. 2, on the upper cylinder 121T, a cylindrical inner peripheral surface 137T is formed. On the inside of the inner peripheral surface 137T of the upper cylinder 121T, the upper piston 125T, which has an outer diameter smaller than the inner diameter of an inner peripheral surface 137T of the upper cylinder 121T, is arranged, and between the inner peripheral surface 137T and an outer peripheral surface 139T of the upper piston 125T, the upper compression chamber 133T, which sucks, compresses, and discharges the refrigerant, is formed. On the lower cylinder 121S, a cylindrical inner peripheral surface 137S is formed. On the inside of the inner peripheral surface 137S of the lower cylinder 121S, the lower piston 125S, which has an outer diameter smaller than the inner diameter of the inner peripheral surface 137S of the lower cylinder 121S, is arranged, and between the inner peripheral surface 137S and an outer peripheral surface 139S of the lower piston 125S, the lower compression chamber 133S, which sucks, compresses, and discharges the refrigerant, is formed.

The upper cylinder 121T includes an upper lateral projecting portion 122T, which projects in the radial direction of the cylindrical inner peripheral surface 137T from a circular outer peripheral portion. On the upper lateral projecting portion 122T, an upper vane groove 128T, which extends radially outward from the upper cylinder chamber 130T, is provided. In the upper vane groove 128T, an upper vane 127T is arranged to be slidable. The lower cylinder 121S includes a lower lateral projecting portion 122S, which projects in the radial direction of the cylindrical inner peripheral surface 137S from the circular outer peripheral portion. On the lower lateral projecting portion 122S, a lower vane groove 128S, which extends radially outward from the lower cylinder chamber 130S, is provided. In the lower vane groove 128S, a lower vane 127S is arranged to be slidable.

On the upper cylinder 121T, from the outer lateral surface at the position overlapping the upper vane groove 128T, an upper spring hole 124T is provided at a depth not running through the upper cylinder chamber 130T. At the upper spring hole 124T, an upper spring 126T is arranged. On the lower cylinder 121S, from the outer lateral surface at the position overlapping the lower vane groove 128S, a lower spring hole 124S is provided at a depth not running through the lower cylinder chamber 130S. At the lower spring hole 124S, a lower spring 126S is arranged.

On the lower cylinder 121S, formed is a lower pressure guiding path 129S that guides the compressed refrigerant in the compressor housing 10 by making the outside in the radial direction of the lower vane groove 1288 communicate with the inside of the compressor housing 10 via an opening, and that applies a back pressure to the lower vane 127S by the pressure of the refrigerant. The compressed refrigerant in the compressor housing 10 is also introduced from the lower spring hole 124S. On the upper cylinder 121T, formed is an upper pressure guiding path. 1291 that guides the compressed refrigerant in the compressor housing 10 by making the outside in the radial direction of the upper vane groove 128T communicate with the inside of the compressor housing 10 via an opening, and that applies a back pressure to the upper vane 127T by the pressure of the refrigerant. The compressed refrigerant in the compressor housing 10 is also introduced from the upper spring hole 124T.

On the upper lateral projecting portion. 122T of the upper cylinder 121T, an upper suction hole 135T as a through-hole to which the upper suction pipe 105 is fitted is provided. On the lower lateral projecting portion 122S of the lower cylinder 121S, a lower suction hole 135S, as a through-hole to which the lower suction pipe 104, is fitted is provided.

The upper cylinder chamber 130T is closed at the upper and lower sides by the upper end plate 160T and the intermediate partition plate 140, respectively. The lower cylinder chamber 130S is closed at the upper and lower sides by the intermediate partition plate 140 and the lower end plate 1608, respectively. In other words, the compression unit 12 includes the intermediate partition plate 140 that partitions the cylinder chamber into the upper cylinder chamber 130T and the lower cylinder chamber 130S.

Figure 3:
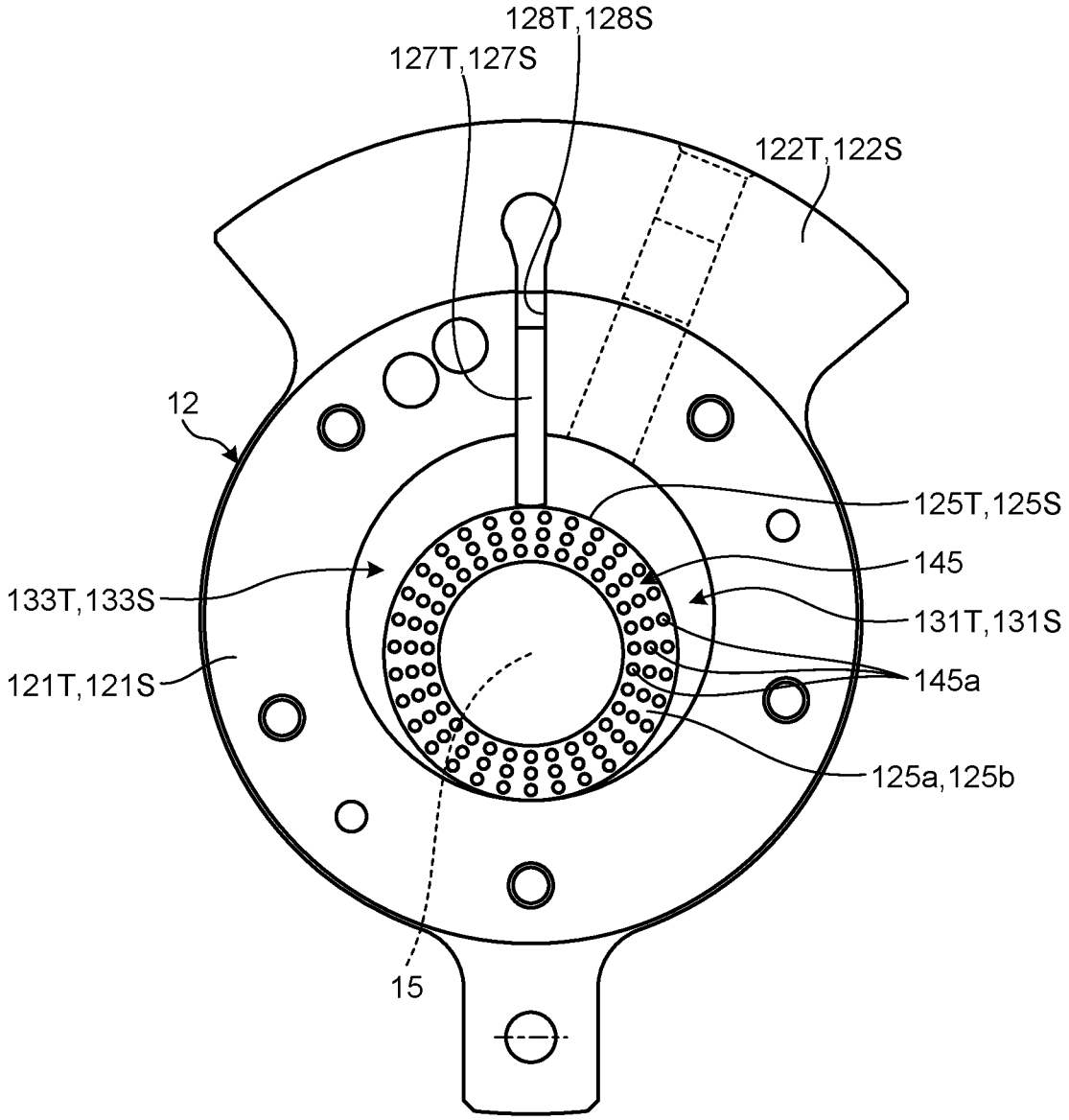
FIG. 3 is a plan view illustrating a principal part of the compression unit in the embodiment.

The upper cylinder chamber 130T is sectioned, as the upper vane 1271 is pressed by the upper spring 126T and is brought into contact with the outer peripheral surface 139T of the upper piston 125T, into an upper suction chamber 131T that communicates with the upper suction hole 135T, and into the upper compression chamber 133T that communicates with an upper discharge hole 190T, which is provided on the upper end plate 160T (see FIG. 3). The lower cylinder chamber 130S is sectioned, as the lower vane 127S is pressed by the lower spring 126S and is brought into contact with the outer peripheral surface 139S of the lower piston 125S, into a lower suction chamber 131S that communicates with the lower suction hole 135S, and into the lower compression chamber 133S that communicates with a lower discharge hole 190S, which is provided on the lower end plate 160S (see FIG. 3).

As illustrated in FIG. 2, on the upper end plate 160T, the upper discharge hole 190T, which passes through the upper end plate 160T and communicates with the upper compression chamber 133T of the upper cylinder 121T, is provided, and on the outlet side of the upper discharge hole 190T, an upper valve seat (not depicted) is formed around the upper discharge hole 190T. On the upper end plate 160T, an upper discharge-valve accommodating recessed portion. 1641, which extends in a groove shape in the circumferential direction of the upper end plate 160T from the position of the upper discharge hole 190T, is formed.

In the upper discharge-valve accommodating recessed portion 1641, accommodated are a reed-valve type upper discharge valve 200T for which the rear end portion is fixed in the upper discharge-valve accommodating recessed portion 164T by an upper rivet 202T, and the front portion opens and closes the upper discharge hole 190T, and an entire upper discharge valve retainer 2011 for which the rear end portion is overlapped with the upper discharge valve 200T and fixed in the upper discharge-valve accommodating recessed portion 164T by the upper rivet 202T, and the front portion is curved (warped) and regulates the opening degree of the upper discharge valve 2001.

On the lower end plate 160S, the lower discharge hole 190S, which passes through the lower end plate 160S and communicates with the lower compression chamber 133 of the lower cylinder 121S, is provided. On the lower end plate 160S, a lower discharge-valve accommodating recessed portion (not depicted), which extends in a groove shape in the circumferential direction of the lower end plate 1603 from the position of the lower discharge hole 190S, is formed.

In the lower discharge-valve accommodating recessed portion, accommodated are a reed-valve type lower discharge valve 200S for which the rear end portion is fixed in the lower discharge-valve accommodating recessed portion by a lower rivet 202S, and the front portion one and closes the lower discharge hole 190S, and an entire lower discharge valve retainer 201S for which the rear end portion is overlapped with the lower discharge valve 200S and fixed in the lower discharge-valve accommodating recessed portion by the lower rivet 202S, and the front portion is curved (warped) and regulates the opening degree of the lower discharge valve 200S.

In addition, between the upper end plate 160T and the upper end plate cover 170T having the bulging portion that are closely fixed to each other, an upper end-plate cover chamber 180T is formed. Between the lower end plate 160S and the flat plate-shaped lower end plate cover 170S that are closely fixed to each other, a lower end-plate cover chamber 180S (see FIG. 1) is formed. A plurality of refrigerant passage holes 136, which run through the lower end plate 160S, the lower cylinder 121S, the intermediate partition plate 140, the upper end plate 160T, and the upper cylinder 121T and that communicates with the lower end-plate cover chamber 180S and the upper end-plate cover chamber 180T, is provided.

The following describes the flow of refrigerant by the rotation of the rotating shaft 15. In the upper cylinder chamber 130T, by the rotation of the rotating shaft 15, as the upper piston 125T fitted to the upper eccentric portion. 152T of the rotating shaft 15 revolves along the inner peripheral surface 137T of the upper cylinder 121T (outer peripheral surface of the upper cylinder chamber 130T), the upper suction chamber 131T sucks the refrigerant from the upper suction pipe 105 while expanding the volume, the upper compression chamber 133T compresses the refrigerant while reducing the volume, and when the pressure of the compressed refrigerant becomes higher than the pressure of the upper end-plate cover chamber 180T outside of the upper discharge valve 200T, the upper discharge valve 200T is opened, and the refrigerant is discharged from the upper compression chamber 133T to the upper end-plate cover chamber 180T. The refrigerant, which is discharged to the upper end-plate cover chamber 180T, is discharged into the compressor housing 10 from an upper end-plate cover discharge hole 172T (see FIG. 1), which is provided on the upper end plate cover 170T.

Furthermore, in the lower cylinder chamber 130S, by the rotation of the rotating shaft 15, as the lower piston 125S, which is fitted to the lower eccentric portion 152S of; the rotating shaft 15, revolves along the inner peripheral surface 137S of the lower cylinder 121S (outer peripheral surface of the lower cylinder chamber 130S), the lower suction chamber 131S sucks the refrigerant from the lower suction pipe 104 while expanding the volume, the lower compression chamber 133S compresses the refrigerant while reducing the volume, and when the pressure of the compressed refrigerant becomes higher than the pressure of the lower end-plate cover chamber 180S outside of the lower discharge valve 200S, the lower discharge valve 200S is opened, and the refrigerant is discharged from the lower compression chamber 133S to the lower end-plate cover chamber 180S. The refrigerant, which is discharged to the lower end-plate cover chamber 180S, passes through the refrigerant passage holes 136 and the upper end-plate cover chamber 180T, and is discharged into the compressor housing 10 from the upper end-plate cover discharge hole 172T, which is provided on the upper end plate cover 170T.

The refrigerant, which is discharged into the compressor housing 10, is guided to the upper side of the motor 11 through a cutout (not depicted), which is provided on the outer periphery of the stator 111 and communicating with the upper and lower portions, a gap (not depicted) in a winding portion of the stator 111, or a gap 115 (see FIG. 1) between the stator 111 and the rotor 112, and is discharged from the discharge pipe 107 as a discharge portion arranged on the upper portion of the compressor housing 10.

Characteristic Configuration of Rotary Compressor

Next, a characteristic configuration of the rotary compressor 1 of the embodiment will be described. Features of the embodiment include that, in order to enhance the airtightness of the upper compression chamber 133T and the lower compression chamber 133S (hereinafter also referred to as compression chamber 133), the compression unit 12 has oil-film retention regions that retain an oil film of lubricating oil 18.

FIG. 3 is a plan view illustrating a principal part of the compression unit 12 in the embodiment. As illustrated in FIG. 3, the upper piston 125T and the lower piston 125S (hereinafter also referred to as piston 125) that the compression unit 12 includes oil-film retention regions 145, which retain an oil film of the lubricating oil 18, formed on an upper end face 125*a* and a lower end face 125*b* in the axial direction of the rotating shaft 15. The oil-film retention region 145 is formed continuously in the circumferential direction of the piston 125, and has an array of a plurality of recessed portions 145*a* that retain the lubricating oil 18. That is, the recessed portions 145*a* are formed around the entire circumference of the piston 125 in the circumferential direction, so that the oil film is smoothly formed over the entire circumference of the piston 125.

The lubricating oil 18, which is stored inside the compressor housing 10, is supplied to the piston 125, the upper end plate 160T, and the lower end plate 160S along the axial direction of the rotating shaft 15, for example. The lubricating oil 18, which is supplied around the upper piston 125T, accumulates in the respective recessed portions 145*a* of the oil-film retention region 145, so that it is retained as an appropriate oil film between the upper end face 125*a* of the upper piston 125T and the upper end plate 160T, and between the lower end face 125*b* of the upper piston 125T and the intermediate partition plate 140 (see FIG. 5). Similarly, the lubricating oil 18, which is supplied around the lower piston 125S, accumulates in the respective recessed portions 145*a* of the oil-film retention region 145, so that it is retained as an appropriate oil film between the upper end face 125*a* of the lower piston 125S and the intermediate partition plate 140, and between the lower end face 125*b* of the lower piston 125S and the lower end plate 160S.

Figure 4A:
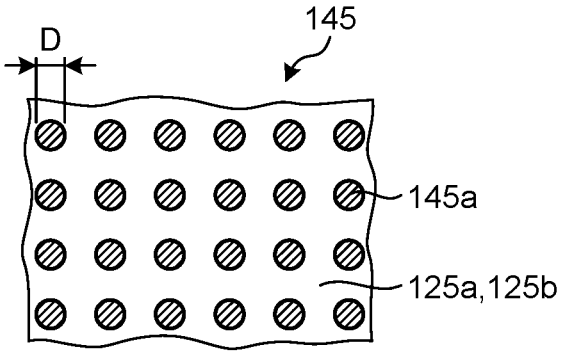
FIG. 4A is an enlarged plan view illustrating an oil-film retention region of a piston in the embodiment.
Figure 4B:
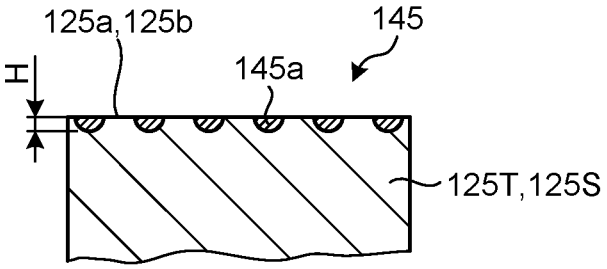
FIG. 4B is an enlarged longitudinal sectional view of the oil-film retention region of the piston in the embodiment.

FIG. 4A is an enlarged plan view illustrating the oil-film retention region 145 of the piston 125 in the embodiment. FIG. 4B is an enlarged longitudinal sectional view of the oil-film retention region 145 of the piston. 125 in the embodiment. As illustrated in FIG. 4A, the recessed portions 145*a* in the oil-film retention region 145 are formed in a minute circular shape in planar view, and are arrayed in a lattice form at predetermined intervals, for example. Each recessed portion 145*a* is formed to have, the same diameter D. As illustrated in FIG. 4B, the recessed portions 145*a* are formed to be hemispherical in cross-sectional shape, for example. Each recessed portion 145*a* is formed to have the same depth. H in the axial direction (vertical direction of the piston 125) of the rotating shaft 15.

Figure 4C:
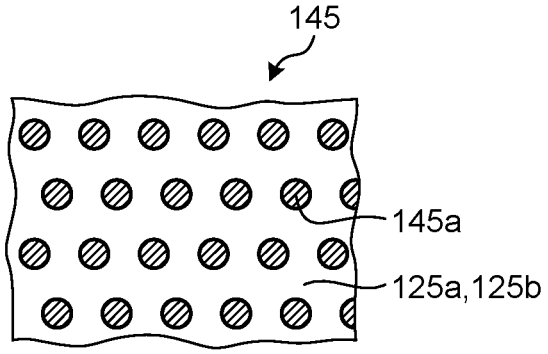
FIG. 4C is a plan view illustrating another array pattern of recessed portions that the oil-film retention region has in the embodiment.

FIG. 4C is a plan view illustrating another array pattern of the recessed portions 145*a* that the oil-film retention region 145 has in the embodiment. As illustrated in FIG. 4C, the recessed portions 145*a* may be arrayed in a zigzag pattern, and the shape and arrangement of each recessed portion 145*a* are not limited.

The oil-film retention region 145 is what is called micro-texture that is formed by surface machining called micro-texturing using a laser micro-fabrication machine. The oil-film retention region 145 is formed by irradiating the upper end face 125*a* and the lower end face 125*b* of the piston 125 with an ultrashort pulsed laser such as a picosecond laser or a femtosecond laser, for example. Forming the recessed portions 145*a* by such laser processing is preferable as protrusions, which are called burrs, do not occur on the peripheral edge of the recessed portion 145*a* and as the processing speed of the recessed portion 145*a* is fast. The depth of the recessed portion 1455 can be formed to about 1 μm with a single irradiation of the ultrashort pulsed laser, and thus a depth of 3 μm or less is preferable when considering processing speed and productivity. Each recessed portion. 145*a* is arranged so that the opening edge of the recessed portion 145*a* is circular, and does not overlap the outer circumferential edge and the inner circumferential edge of the piston 125.

Action of Oil-film Retention Region

Figure 5:
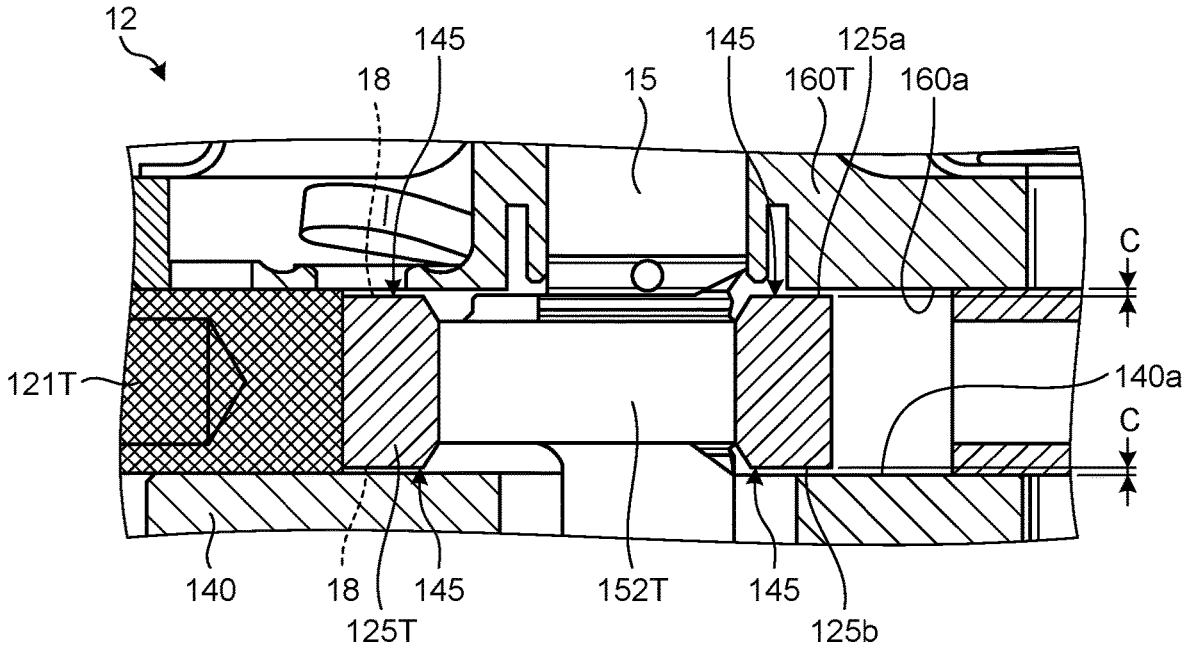
FIG. 5 is a longitudinal sectional view for explaining the action of the oil-film retention region in the embodiment.

FIG. 5 is a longitudinal sectional view for explaining the action of the oil-film retention region. 145 in the embodiment. In this case, the oil-film retention region 145 of the upper piston 125T will be described, but the description also applies to the oil-film retention region 145 of the lower piston 125S which is the same as the oil-film retention region 145 of the upper piston. 125T.

As illustrated in FIG. 5, as the lubricating oil 18 is accumulated in each recessed portion 145*a* of the oil-retention region 145 of the upper end face 125*a* of the upper piston 125T, the oil film is smoothly retained along the upper end face 125*a*, so that the portion, between the upper end face 125*a* of the upper piston 125T and a sliding surface 160*a* of the upper end plate 160T, is appropriately sealed by the oil film. Similarly, as the lubricating oil 18 is accumulated in each recessed portion 145*a* of the oil-film retention region 145 of the lower end face 125*b* of the upper piston 125T, the oil film is smoothly retained along the lower end face 125*b*, so that the portion, between the lower end face 125*b* of the upper piston 125T and a sliding surface 140*a* of the intermediate partition plate 140, is appropriately sealed by the oil film.

In the axial direction of the rotating shaft 15, the oil film is pressed and compressed at a gap C between the upper end face 125*a* of the upper piston 125T and the sliding surface 160*a* of the upper end plate 160T, and a gap C between the lower end face 125*b* of the upper piston. 125T and the sliding surface 140*a* of the intermediate partition plate 140, so that positive pressure is generated in the lubricating oil 18, which is accumulated in each recessed portion 145*a* of the oil-film retention region 145. Due to the positive pressure generated in each recessed portion 145*a* and the lubricating oil 18 being accumulated in the recessed portions 145*a*, the oil-film retention region. 145 is stably maintained in an oil-film retained state, so that the airtightness the upper compression chamber 133T by the oil film, is enhanced.

The compression unit 12 in the present embodiment is downsized, and in the axial direction of the rotating shaft 15, the gap C between the upper end face 125*a* of the upper piston 125T and the sliding surface 160*a* of the upper end plate 160T, and the gap C between the lower end face 125*b* of the upper piston 125T and the sliding surface 140*a* of the intermediate partition plate 140, are greater than 0 and are 1/1000 or less of the height of the upper piston 125T in the axial direction of the rotating shaft 15 (vertical direction of the upper piston 125T). Each gap C is 10 μm or less and is formed to about 4 to 5 μm, for example. When the Gap C is minute due to downsizing of the compression unit 12 as in the foregoing, forming an appropriate oil film in the gap C becomes difficult, but the formation of the oil-film retention region 145 allows an oil film to be formed appropriately in the gap C.

In the oil-film retention region 145, an area ratio occupied by the total of the opening areas of the recessed portions 145*a* to the area of the upper end face 125*a* is 40% or less, and a depth H for each recessed portion 145*a* to the upper end face 125*a* is 3 μm or less. Similarly, in the oil-film retention region 145, the area ratio occupied by the total of the opening areas of the multiple recessed portions 145*a* to the area of the lower end face 125*b* is 40% or less, and the depth H for each recessed portion 145*a* to the lower end face 125*b* is 3 μm or less. The opening area of the recessed portion 145*a* refers to the circular area in the upper end face 125*a* or the lower end face 125*b*. As the area ratio and depth H of the oil-film retention region 145*a* satisfy the above-described numerical ranges, it allows an appropriate oil film to be formed, deterioration of the workability of the recessed portion. 145*a* to be reduced, and the complication in the machining process of the oil-film retention region 145 to be avoided.

Volumetric Efficiency

As in the present embodiment, in the case where the diameter ID of each recessed portion 145*a* of the oil-film retention region 145 is formed at 50 μm on the upper end face 125*a* and the lower end face 125*b* of the piston. 125, the relation among the volumetric efficiency of the above-described gap C, the pitch of each recessed portion. 145*a*, and the depth of the recessed portion 145*a* will be described with reference to Table 1.

With the volumetric efficiency being 100% when the recessed portions 145*a* are not formed on the upper end face 125*a* and the lower end face 125*b* of the piston 125, the volumetric efficiency [%] when the recessed portions 145*a* are formed on the upper end face 125*a* and the lower end face 125*b* as in the present embodiment will be described. Volumetric efficiency=(Actual measured refrigeration capacity)/(Theoretical refrigeration capacity). In the rotary compressor 1, the actual measured refrigeration capacity is smaller than the theoretical refrigeration capacity due to the effect of the refrigerant gas leaking from the above-described gap C and the like during compression. That is, increasing the volumetric efficiency means that the refrigerant gases from the gaps C become smaller.

TABLE 1

Recessed portion of oil-film retention region: 50 μm diameter

| | | Pitch | |
|---|---|---|---|
| Volumetric efficiency | | 115 μm (Area ratio 15%) | 75 μm (Area ratio 35%) |
| Depth | 1 μm | 100.7% | 100.7% |
| | 3 μm | — | 100.4% |

As illustrated in Table 1, when, the recessed portions are formed such that the pitch of each recessed portion 145*a* is 115 μm, the depth of the recessed portion 145*a* is 1 μm, and the area efficiency of the recessed portions 145*a* is 15%, the volumetric efficiency was 100.7% and the volumetric efficiency was increased by 0.7%. When the recessed portions are formed such that the pitch of each recessed portion 145*a* is 75 μm, the depth of the recessed portion 145*a* is 1 μm, and the area efficiency of the recessed portions 145*a* is 35%, the volumetric efficiency was 100.7% and the volume efficiency was increased by 0.7%. When the recessed portions are formed such that the pitch of each recessed portion 145*a* is 75 μm, the depth of the recessed portion 145*a* is 3 μm, and the area efficiency of the recessed portions 145*a* is 35%, the volumetric efficiency was 100.4% and the volumetric efficiency was increased by 0.4%.

In the embodiment, the oil-film retention region 145 is formed on the upper end face 125*a* and the lower end face 125*b* of the piston 125, so that the sealing property of the gap C is enhanced by the lubricating oil 18 that accumulates in the recessed portions 145*a*, and the leakage of the refrigerant gas from the gap C is reduced, thereby increasing the volumetric efficiency. That is, in the embodiment, as the volumetric efficiency is increased as mentioned above, the sealing property of the gap Cl by the oil film is enhanced, and the airtightness of the compression chamber 133 is enhanced.

Modifications of Embodiment

The following describes modifications of the oil-film retention region with reference to the drawings. In each modification, the constituent members identical to those of the above-described embodiment are denoted by the reference signs identical to those of the embodiment, and the description thereof will be omitted.

First Modification

Figure 6:
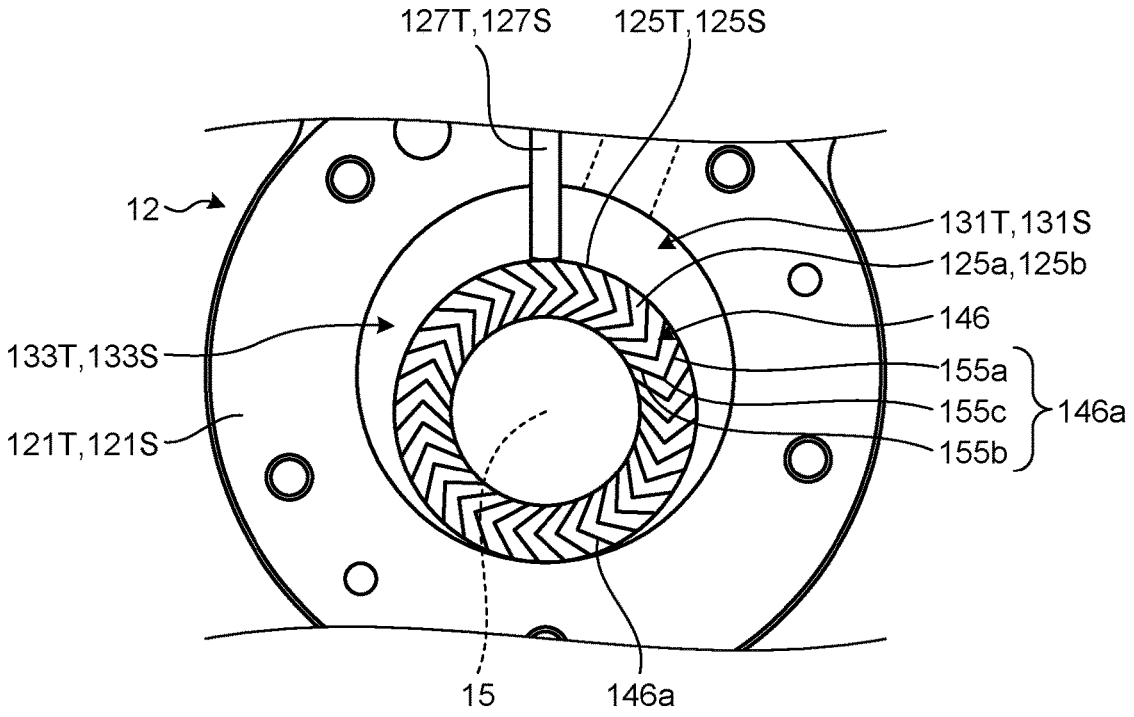
FIG. 6 is a plan view illustrating an oil-film retention region of a first modification in the embodiment.

FIG. 6 is a plan view illustrating an oil-film retention region of a first modification in the embodiment.

Figure 7:
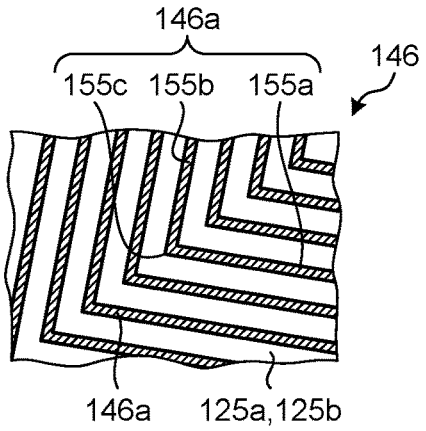
FIG. 7 is an enlarged plan view illustrating recessed portions that the oil-film retention region of the first modification has in the embodiment.

FIG. 7 is an enlarged plan view illustrating an enlarged view of recessed portions that the oil-film retention region of the first modification has in the embodiment. The oil-film retention region of the first modification is different from the above-described embodiment in the shape of the recessed portion.

As illustrated in FIG. 6 and FIG. 7, an oil-film retention region 146 of the first modification is formed on the upper end face 125*a* and the lower end face 125*b* of the piston 125, and has a plurality of recessed portions 146*a*. Each of the recessed portions 146*a* is formed in a linear shaped pattern having a bend portion. 155*c*, and is arranged in what is called a herringbone-like array pattern.

Each recessed portion 146*a* includes a linear first groove 155*a*, which is arranged in plurality on the outer circumferential side of the upper end face 125*a* at intervals in a circumferential direction of the piston 125, and a linear second groove 155*b*, which is arranged in plurality on the inner circumferential side of the upper end face 125*a* at intervals in the circumferential direction of the piston 125. The inner circumferential end portion of the first groove 155*a* and the outer circumferential end portion of the second groove 155*b* are connected so as to form the bend portion 155*c*, and the bend portion 155*c* is arranged in the center of the upper end face 125*a* in the radial direction of the piston 125. Each of the V-shaped recessed portions 146*a* is uniformly arranged on the upper end face 125*a* so as to be at equal intervals on the same circumference with respect to the circumferential direction of the piston 125. The oil-film retention region. 146 on the lower end face 125*b* of the piston 125 is also formed in the same manner as that in the foregoing.

The dimensions of each groove width of the first groove 155*a* and the second groove 155*b* are not limited, as long as each recessed portion 146*a* of the oil-film retention region 146 has a depth of 3 μm or less, and the area ratio of the oil-film retention region 146 to the area of the upper end face 125*a* (lower end face 125*b*) is 40% or less. The linear recessed portion having the bend portion is not limited to a V-shape, and may be formed in a W-shape or an S-shape, for example. The recessed portion may be formed in a curved shape, or may be formed with a combination of a plurality of types of curves.

In the recessed portion 146*a* of the oil-film retention region 146 of the first modification, the lubricating oil 18, which moves from the outer circumferential side of the piston. 125 toward the inner circumferential side along the first groove 155*a*, and the lubricating oil 18, which moves from the inner circumferential side of the piston. 125 toward the outer circumferential side along the second groove 155*b*, at the bend portion. 155*c*, thereby causing positive pressure generated in the bend portion 155*c* to be increased. Thus, in addition to the positive pressure generated in the recessed portion 146*a* by the oil film compressed in the above-described gap C, the positive pressure generated in the bend portion 155*c* is increased, so that the lubricating oil 18 can be retained further stably at the bend portion 155*c* and the sealing property of the oil film is enhanced by the bend portion 155*c*. Therefore, the retaining state of the oil film by the recessed portion 146*a* is further stabilized, and the airtightness of the compression chamber 133 is further enhanced.

The shape of the recessed portion 146*a* in the first modification is not limited to a V-shape, but it only needs to be linear having the bend portion 155*c*, and the same effect as that of the first modification can be obtained. The herringbone-like array pattern is not limited to a structure in which the bend portion 155*c* is arranged in the center of the upper end face 125*a* (lower end face 125*b*) in the radial direction of the piston 125, and the bend portion 155*c* may be arranged closer to the inner circumferential side of the upper end face 125*a* (lower end face 125*b*), for example. By changing the position of the bend portion 155*c* in this manner, the position, at which the positive pressure is increased in the recessed portion 146*a*, may be adjusted as appropriate.

Second Modification

Figure 8:
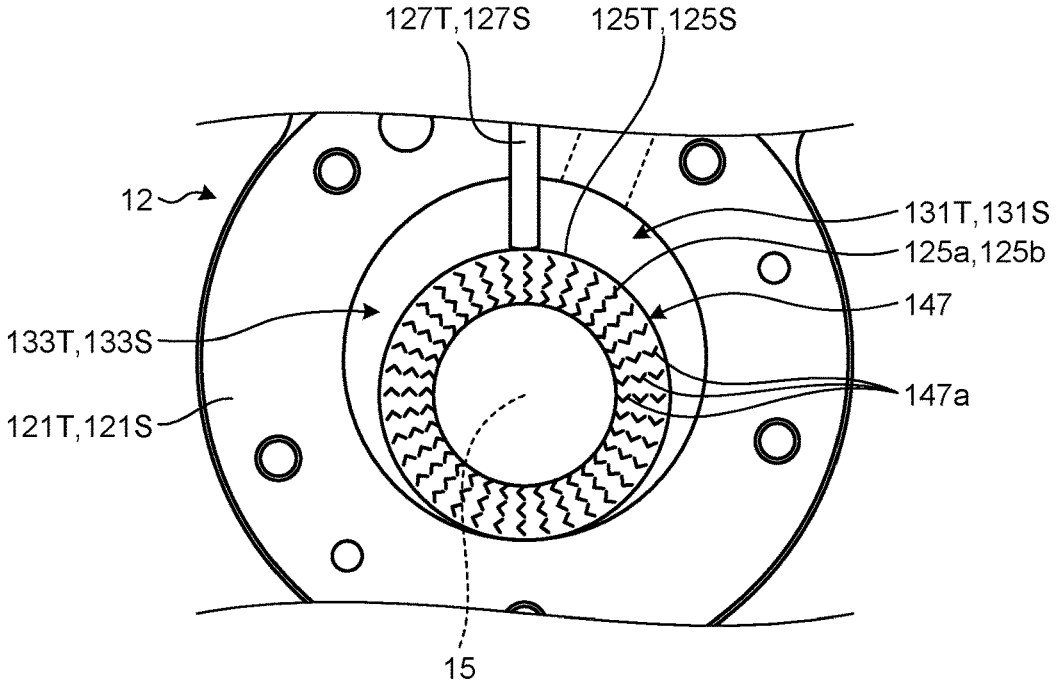
FIG. 8 is a plan view illustrating an oil-film retention region of a second modification in the embodiment.

FIG. 8 is a plan view illustrating an oil-film retention region of a second modification in the embodiment. The oil-film retention region of the second modification is different from the first modification in that it has a plurality of herringbone-like array patterns.

As illustrated in FIG. 8, an oil-film retention region 147 of the second modification is formed on the upper end face 125*a* and the lower end face 125*b* of the piston 125, and has a plurality of recessed portions 147*a*. Each of the recessed portions 147*a* is formed in a V-shape and is arranged with three herringbone-like array patterns. The three herringbone-like array patterns are in line along the radial direction of the piston 125. Thus, in the radial direction of the piston, each recessed portion 147*a* has a plurality of first grooves 155*a* and a plurality of second grooves 155*b* alternately arranged, and has a plurality of bend portions 155*c* (see FIGS. 6 and 7). The oil-film retention region 147 on the lower end face 125*b* of the piston 125 is also formed in the same manner as that in the foregoing. In the second modification also, the area ratio of the recessed portions 147*a* and the depth of each recessed portion 147*a* are formed in the same manner as in the above-described embodiment.

The oil-film retention region 147 of the second modification has a plurality of V-shaped recessed portions 147*a*, which is arranged in the radial direction of the piston 125, so that the positive pressure, which is generated at the V-shaped bend portion 155*c*, is increased as with the first modification, and the lubricating oil 18 can be stably retained at the locations of the bend portions 155*c* in the radial direction of the piston 125. Therefore, in the radial direction of the piston 125, the sealing property of the oil film by each bend portion. 155*c* is enhanced, the retaining state of the oil film by the oil-film retention region 147 is further stabilized, and the airtightness in the compression chamber 133 is further enhanced.

In the second modification, the number of herringbone-like array patterns arranged in the radial direction of the piston 125, is not limited. For example, the V-shaped recessed portion 147*a* located in the center of the upper end face 125*a* in the radial direction of the piston 125 may be connected, at both ends of the V shape, to the recessed portion 147*a* on the inner circumferential side of the upper end face 125*a* and the recessed portion 147*a* on the outer circumferential side. As in the foregoing, when the recessed portion 147*a* is, for example, formed in a zigzag shape in the radial direction of the piston 125, the number of bend portions 155*c* is increased, so that the sealing property by the oil-film retention region 147 is further enhanced.

Third Modification

Figure 9:
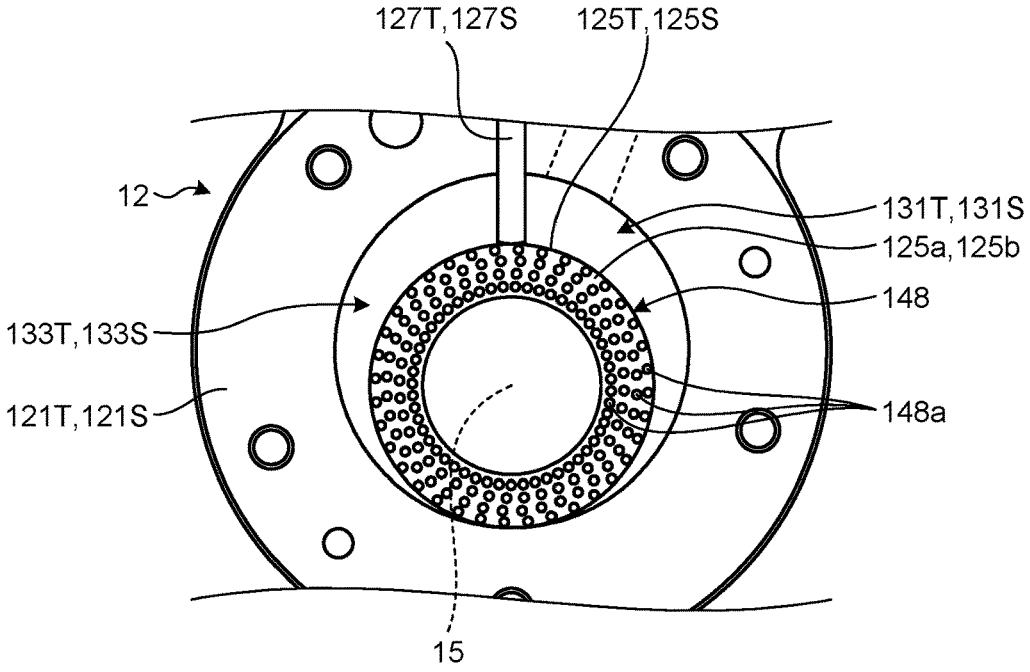
FIG. 9 is a plan view illustrating an oil-film retention region of a third modification in the embodiment.

FIG. 9 is a plan view illustrating an oil-film retention region of a third modification in the embodiment. The oil-film retention region of the third modification is different from the first embodiment in the array patterns of circular recessed portions.

As illustrated in FIG. 9, an oil-film retention region 148 of the third modification is formed on the upper end face 125*a* and the lower end face 125*b* of the piston 125, and has a plurality of recessed portions 148*a*. Each of the recessed portions 148*a* as formed an a circular shape having the same diameter, and the pitch of each recessed portion 148*a* on the inner circumferential side of the upper end face 125*a*, is made smaller than the pitch of each recessed portion 146*a* on the outer circumferential side of the upper end face 125*a*.

Therefore, in the oil-film retention region 148, the density of the recessed portions 148*a* on the inner circumferential side of the upper end face 125*a*, which occupies the unit area of the upper end face 125*a*, is greater than the density of the recessed portions 148*a* on the outer circumferential side of the upper end face 125*a*. In other words, the oil-film retention region 148 includes an outer circumferential region and an inner circumferential region having different densities of the recessed portions 148*a*. The oil-film retention region 148 on the lower end face 125*h* of the piston 125 is also formed in the same manner as that in the foregoing. In the third modification also, the area ratio of the recessed portions 148*a* and the depth of each recessed portion 146*a* are formed in the same manner as in the above-described embodiment.

The oil-film retention region 148 of the third modification increases the density of the recessed portions 148*a* on the inner circumferential side of the upper end face 125*a*, so that the oil film on the inner circumferential side of the piston 125 is increased relative to that on the outer circumferential side, and the stability of the retaining state of the oil film of the recessed portions 148*a* on the inner circumferential side of the piston 125 is enhanced. Thus, the oil-film retention region 148 further stabilizes the retaining state of the oil film on the inner circumferential side of the upper end face 125*a*, and the sealing property by the oil film is further enhanced, so that the airtightness in the compression chamber 133 is further enhanced.

The oil-film retention region 148 of the third modification has been formed with the same diameter for each recessed portion 148*a*, but it may have a plurality of types of circular recessed portions having different diameters, and may have a plurality of types of circular recessed portions having different depths. The oil-film retention region 148 may be formed so that the diameter of the recessed portion 148*a* on the inner circumferential side of the upper end face 125*a* is smaller than that of the recessed portion 148*a* on the outer circumferential side, for example. The oil-film retention region 148 only needs to have the density of the recessed portions 148*a* on the inner circumferential side of the upper end face 125*a*. (lower end face 125*b*) higher than that of the recessed portions 148*a* on the outer circumferential side, and is not limited to the circular-shaped recessed portions 148*a*.

Although not illustrated, when the oil-film retention region is formed on the upper end face 125*a* (lower end face 125*b*) of the piston 125, a plurality of ring-shaped recessed portions may be arranged concentrically at intervals with respect to the center of the piston 125. In this case, in the radial direction of the piston 125, by making the distance between the ring-shaped recessed portions narrower on the inner circumferential side than that on the outer circumferential side of the piston 125, the density of the recessed portions on the inner circumferential side may be increased.

Fourth Modification

Figure 10:
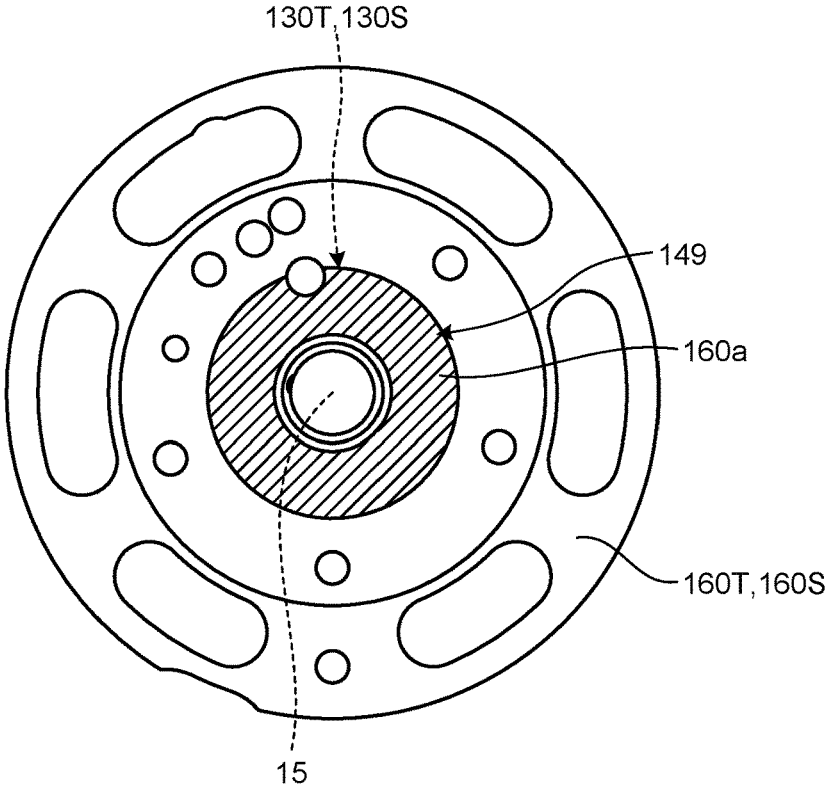
FIG. 10 is a plan view illustrating an oil-film retention region of a fourth modification that an upper end plate has.

FIG. 10 is a plan view illustrating an oil-film retention region of a fourth modification that the upper end plate 160T has. The fourth modification is different from the embodiment and the first to the third modifications in that the oil-film retention region is formed on the upper end plate 160T.

As illustrated in FIG. 10, an oil-film retention region 149 of the fourth modification is formed annularly on the sliding surface 160*a* of the upper end plate 160T, in place of the oil-film retention region formed on the upper end face 125*a* of the upper piston 125T. The oil-film retention region 149 corresponds to the sliding region on which the upper end face 125*a* of the upper piston. 125T slides, and is formed in the entire area on the sliding surface 160*a* of the upper end plate 160T in the upper cylinder chamber 1301. In FIG. 10, in the hatched region illustrated as the oil-film retention region 149, as with the above-described embodiment and others, a plurality of recessed portions (not depicted) are arranged. The array pattern of the recessed portions, the area ratio, and the dimensions of each recessed portion are formed in the same way as in any of the above-described embodiment and the first to the third modifications.

Although not illustrated, the oil-film retention region 149 of the fourth modification may be formed on the sliding surface of the lower end plate 160S, in place of the oil-film retention region formed on the lower end face 125*b* of the lower piston 125S. In this case, it is the same as the oil-film retention region of the upper end plate 160T illustrated in FIG. 10.

In the fourth modification also, as with the above-described embodiment and others, the retaining state of the oil film by the oil-film retention region 149 is enhanced and the airtightness in the compression chamber 133 is enhanced.

Fifth Modification

Figure 11:
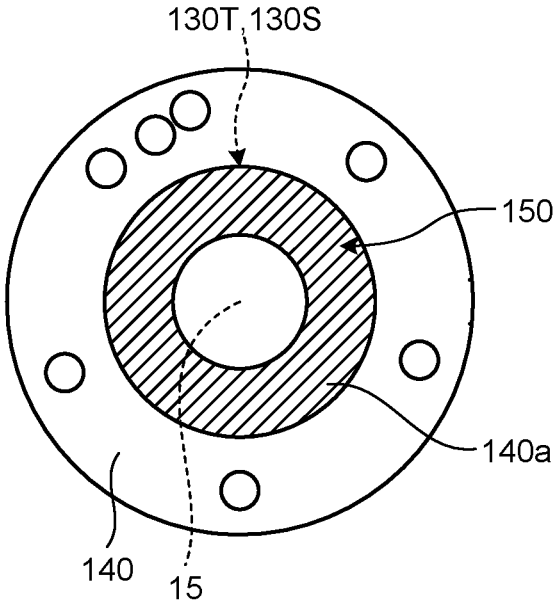
FIG. 11 is a plan view illustrating an oil-film retention region of a fifth modification that an intermediate partition plate has.

FIG. 11 is a plan view illustrating an oil-film. retention region of a fifth modification that the intermediate partition plate 140 has. The fifth modification is different from the embodiment and the first to the third modifications in that the oil-film retention region is formed on the intermediate partition plate 140.

As illustrated in FIG. 11, an oil-film retention region 150 of the fifth modification is formed annularly on the sliding surface 140*a* of the intermediate partition plate 140, in place of the oil-film retention region formed on the lower end face 125*b* of the upper piston 125T. The oil-film retention region 150 corresponds to the sliding region on which the lower end face 125*b* of the upper piston 125T slides, and is formed in the entire area on the sliding surface 140*a* of the intermediate partition plate 140 in the upper cylinder chamber 1301. In FIG. 11, in the hatched region illustrated as the oil-film retention region 150, as with the above-described embodiment and others, a plurality of recessed portions (not depicted) are arranged. The array pattern of the recessed portions, the area ratio, and the dimensions of each recessed portion are formed in the same way as in any of the above-described embodiment and the first to the third modifications.

Although not illustrated, the oil-film retention region 150 of the fifth modification may be formed on the sliding surface 140*a* of the intermediate partition plate 140, in place of the oil-film retention region formed on the upper end face 125*a* of the lower piston 125S. In this case, it is the same as the oil-film retention region of the intermediate partition plate 140 illustrated in FIG. 11.

In the fifth modification also, as with the above-described embodiment and others, the retaining state of the oil film by the oil-film retention region 150 is enhanced and the airtightness in the compression chamber 133 is enhanced.

When the oil-film retention regions are formed on the upper end face 125*a* and the lower end face 125*b* of the piston 125, the entire upper piston 125T moves in the upper cylinder chamber 130T, and the entire lower piston 1250 moves in the lower cylinder chamber 130S, so that the lubricating oil 18 accumulated in each recessed portion of the oil-film retention regions is easy to be replaced smoothly with the lubricating oil 18 newly supplied to the gap C, and the lubricity can be properly maintained avoiding deterioration of the oil film. From this point of view, a structure, in which the oil-film retention regions are formed on the upper end face 125*a* and the lower end face 125*b* of the piston 125, is preferred rather than a structure, in which the oil-film retention regions are not formed on the piston 125 but formed on the upper end plate 160T, the lower end plate 1603, and the intermediate partition plate 140.

As mentioned above, in the case of the two-cylinder rotary compressor 1, the oil-film retention regions are formed at four locations of either one of an upper end face 125*a* of the upper piston 125T and the sliding surface 160*a* of the upper end plate 160T, either one of the lower end face 125*b* of the upper piston 125T and the sliding surface 140*a* of the intermediate partition plate 140, either one of the upper end face 125*a* of the lower piston 125S and the sliding surface 140*a* of the intermediate partition plate 140, and either one of the lower end face 125*b* of the lower piston 125S and the sliding surface 160*a* of the lower end plate 160S.

In the case of a one-cylinder rotary compressor, the oil-film retention regions are formed at two locations of either one of the upper end face of the piston and the sliding surface of the upper end plate, and either one of the lower end face of the piston and the sliding surface of the lower end plate. In both two-cylinder and one-cylinder rotary compressors, the oil-film retention region may be formed on both surfaces of the upper end face of the piston and the sliding surface to which the upper end face contacts, and on both surfaces of the lower end face of the piston and the sliding surface to which the lower end face contacts, for example.

Effect of Embodiment

As mentioned above, in the compression unit 12 of the rotary compressor 1 of the embodiment, at least one of the upper end face 125*a* (lower end face 125*b*) in the piston 125, the sliding surface 160*a* of the upper end plate 1607, and the sliding surface of the lower end plate 160S has formed therein the oil-film retention region 145 having an array of a plurality of recessed portions 145*a* that retain the lubricating oil 18. This allows the lubricating oil 18 to accumulate in each recessed portion 145*a* of the oil-film retention region 145 and properly maintain the oil film over the circumferential direction of the piston 125, so that the sealing property of the compression chamber 133 by the oil film is enhanced, and the compression efficiency of the compression chamber 133 is increased.

When downsizing the compression unit 12, it is conceivable that the Gap C between the upper end face 125*a* of the upper piston 125T and the sliding surface 160*a* of the upper end plate 160T, the gap C between the lower end face 125*b* of the upper piston 125T and the sliding surface 140*a* of the intermediate partition plate 140, the gap C between the upper end face 125*a* of the lower piston. 125S and the sliding surface 140*a* of the intermediate partition plate 140, and the gap C between the lower end face 125*b* of the lower piston 125S and the sliding surface of the lower end plate 160S are made small. However, in this case, as the gap C becomes smaller, it may be difficult to sufficiently form an oil film to seal the inside of the compression chamber 133, the sealing property by the oil film may deteriorate, and the compression efficiency of the compression chamber 133 may be lowered. Even in such a case, because the compression unit 12 has the oil-film retention region 145, the deterioration in the sealing property of the compression chamber 133 by the oil film can be suppressed, and the lowering in the compression efficiency of the compression chamber 133 can be suppressed. In other words, forming the oil-film retention region 145 on the upper end face 125*a* (lower end face 125*b*) of the piston 125 allows the above-described gap C to be made small, so that downsizing of the compression unit 12 can be achieved while suppressing the lowering of the compression efficiency of the compression chamber 133.

In the compression unit 12 in the embodiment, the gap C between the upper end face 125*a* of the piston. 125 and the upper end plate 160T (gap C between the lower end face 125*b* and the lower end elate 160S) in the axial direction of the rotating shaft 15, is greater than 0 and is 1/1000 or less of the height of the piston 125 in the axial direction of the rotating shaft 15. When the gap C is minute as in the foregoing, the deterioration in the sealing property of the compression chamber 133 and the lowering in the compression efficiency of the compression chamber 133 can be effectively suppressed by the oil-film retention region 145.

In the oil-film retention region 145 of the compression unit 12 in the embodiment, the area ratio occupied by the total of the opening areas of the recessed portions 145*a* to the area of the upper end face 125*a* (lower end face 125*b*) is 40% or less, and the depth of each recessed portion 145*a* to the upper end face 125*a* (lower end face 125*b*) is 3 μm or less. This allows the deterioration in the workability of the recessed portions 145*a* to be reduced, and the complication in the machining process of the oil-film retention region 145 to be avoided.

Each of the recessed portions 146*a* of the oil-film retention region 146 in the embodiment is formed in a linear shape having the bend portion. 155*c*. This allows the lubricating oil 18 accumulated in the recessed portion 146*a* to be stably retained by the positive pressure generated in the bend portion 155*c*. Thus, the retaining state of the oil film by the recessed portion. 146*a* is further stabilized, so that the sealing property of the compression chamber 133 by the oil film is further enhanced.

Each of the recessed portions 146*a* that the oil-film retention region 146 has in the embodiment includes the linear first groove 155*a*, which is arranged in plurality on the outer circumferential side of the upper end face 125*a*. (lower end face 125*b*) at intervals in the circumferential direction of the piston 125, and the linear second groove 155*b*, which is arranged in plurality on the inner circumferential side of the upper end face 125*a* (lower end face 125*b*) at intervals in the circumferential direction of the piston 125, and the inner circumferential end of the first groove 155*a* and the outer circumferential end of the second groove 155*b* are connected so as to form the bend portion 155*c*. This allows the positive pressure generated at the bend portion 155*c* to be increased, as the lubricating oil 18, which moves from the outer circumferential side of the piston. 125 toward the inner circumferential side along the first groove 155*a*, and the lubricating oil 18, which moves from the inner circumferential side of the piston. 125 toward the outer circumferential side along the second groove 155*b*, collide at the bend portion. 155*c*, so that the lubricating oil 18 can be retained further stably in the bend portion 155*c*. Thus, the retaining state of the of film by the recessed portion 146*a* is further stabilized, so that the sealing property of the compression chamber 133 by the oil film is further enhanced.

In the oil-film retention region 147 in. the embodiment, in the radial direction of the piston. 125, each of the recessed portions 147*a* has a plurality of first grooves 155*a* and a plurality of second grooves 155*b* arranged alternately, and has a plurality of bend portions 155*c*. This allows the lubricating oil 18 to be stably retained at the positions of the bend portions 155*c* in the radial direction of the piston 125. This further stabilizes the retaining state of the oil film by the oil-film retention region 147, so that the sealing property of the compression chamber 133 by the oil film is further enhanced.

In the oil-film retention region 148 in the embodiment, the density of the recessed portions 148*a* on the inner circumferential side of the upper end face 125*a* (lower end face 125*b*), which occupies the unit area of the upper end face 125*a* (lower end face 125*b*), is greater than the density of the recessed portions 148*a* on the outer circumferential side of the upper end face 125*a* (lower end face 125*b*). This increases the oil film on the inner circumferential side of the piston. 125 compared to that on the outer circumferential side, and enhances the stability of the retaining state of the oil film in the recessed portion 148*a* on the inner circumferential side of the piston 125. Thus, in the oil-film retention region. 148, the retaining state of the oil film on the inner circumferential side of the upper end face 125*a* (lower end face 125*b*) is further stabilized, and the sealing property of the compression chamber 133 by the oil film is further enhanced.

REFERENCE SIGNS LIST

1 ROTARY COMPRESSOR
10 COMPRESSOR HOUSING
11 MOTOR
12 COMPRESSION UNIT
15 ROTATING SHAFT
18 LUBRICATING OIL
105 UPPER SUCTION PIPE (SUCTION PORTION)
104 LOWER SUCTION PIPE (SUCTION PORTION)
107 DISCHARGE PIPE (DISCHARGE PORTION)
121T UPPER CYLINDER (CYLINDER.)
121S LOWER CYLINDER (CYLINDER.)
125T UPPER PISTON (PISTON)
125S LOWER PISTON (PISTON)
125*a* UPPER END FACE (END FACE)
125*b* LOWER END FACE (END FACE)
127T UPPER VANE (VANE)
127S LOWER VANE (VANE)
128T UPPER VANE GROOVE (VANE GROOVE)
128S LOWER VANE GROOVE (VANE GROOVE)
131T UPPER SUCTION CHAMBER (SUCTION CHAMBER)
131S LOWER SUCTION CHAMBER (SUCTION CHAMBER)
133T UPPER COMPRESSION CHAMBER (COMPRESSION CHAMBER)
133S LOWER COMPRESSION CHAMBER (COMPRESSION CHAMBER)
140 INTERMEDIATE PARTITION PLATE
140*a* SLIDING SURFACE
145, 146,147, 148, 149, 150 OIL-FILM RETENTION REGION
145*a*, 146*a*, 147*a*, 148*a* RECESSED PORTION
155*a* FIRST GROOVE
155*b* SECOND GROOVE
155*c* BEND PORTION
160T UPPER END PLATE
160*a* SLIDING SURFACE
160S LOWER END PLATE
C GAP
D DIAMETER
H DEPTH

The invention claimed is:

1. A rotary compressor comprising:

a compressor housing that is provided with a refrigerant discharge portion and a refrigerant suction portion;

a compression unit that is arranged in the compressor housing and configured to compress a refrigerant, which is sucked from the suction portion, and discharge the refrigerant from the discharge portion; and a motor that is arranged in the compressor housing and configured to drive the compression unit, wherein the compression unit includes an annular cylinder; an upper end plate that closes an upper side of the cylinder; a lower end plate that closes a lower side of the cylinder; a rotating shaft that is rotated by the motor; a piston that is fitted to the rotating shaft and is configured to revolve along an inner peripheral surface of the cylinder and form a cylinder chamber in the cylinder; and a vane that projects from a vane groove provided on the cylinder into the cylinder chamber and brought into contact with the piston so as to section the cylinder chamber into a suction chamber and a compression chamber, at least one end face of both end faces of the piston in an axial direction of the rotating shaft has formed therein an oil-film retention region having an array of a plurality of recessed portions that are configured to retain lubricating oil, and each of the plurality of recessed portions is not connected to an inner peripheral surface and an outer peripheral surface of the piston and formed in a linear shape having a bend portion, and arranged in a radial direction of the piston with a projecting end of the bend portion oriented in a circumferential direction of the piston.

2. The rotary compressor according to claim 1, wherein, in the axial direction of the rotating shaft, a gap between the at least one end face of the piston and at least one end plate of the upper end plate and the lower end plate is greater than 0, and is 1/1000 or less of a height of the piston in the axial direction, and in the oil-film retention region, an area ratio, which is occupied by a total of opening areas of the recessed portions to an area of the at least one end face, is 40% or less, and a depth of each recessed portion to the at least one end face is 3 μm or less.

3. The rotary compressor according to claim 1, wherein the plurality of recessed portions arranged in the at least one end face of the piston in the radial direction of the piston are formed at intervals in the circumferential direction of the piston around an entire circumference of the piston.

4. The rotary compressor according to claim 1, wherein the plurality of recessed portions arranged in the radial direction of the piston include a recessed portion with both ends in a radial direction connected to an end of an adjacent recessed portion.

* * * * *